US006300290B1

(12) United States Patent
L'Heureux et al.

(10) Patent No.: US 6,300,290 B1
(45) Date of Patent: Oct. 9, 2001

(54) TWO-CYCLE LUBRICATING OIL

(75) Inventors: George C. L'Heureux, Scotch Plains, NJ (US); George M. Tiffany, Minnetrista, MN (US)

(73) Assignee: Infineum International LTD (GB)

( * ) Notice: Subject to any disclaimer, the term of this patent is extended or adjusted under 35 U.S.C. 154(b) by 0 days.

(21) Appl. No.: 09/586,005

(22) Filed: Jun. 2, 2000

(51) Int. Cl.[7] ..... C10M 143/06; C10M 101/02
(52) U.S. Cl. ..... 508/287; 508/572; 508/591
(58) Field of Search ..... 508/287

(56) References Cited

U.S. PATENT DOCUMENTS 3,544,466 12/1970 McDowell et al. ..... 252/46.7
5,049,291 * 9/1991 Miyaji et al. ..... 252/33
5,321,172 * 6/1994 Alexander et al. ..... 585/2
5,547,597 * 8/1996 Koganei et al. ..... 508/409
5,624,890 * 4/1997 Kagaya et al. ..... 508/561
5,888,948 * 3/1999 Meny et al. ..... 508/591
5,942,474 * 8/1999 Tiffany et al. ..... 508/485
5,965,498 * 10/1999 Smythe ..... 508/468

FOREIGN PATENT DOCUMENTS

2081299 A 2/1982 (GB) ..... C10M/1/26

* cited by examiner

*Primary Examiner*—Ellen M. McAvoy

(57) ABSTRACT

There is disclosed a two cycle oil comprising a VI improver, solvent and polyisobutylene which has a Brookfield viscosity of less than 17,000 cP at −40° C. and a KV of at least 6.5 $mm^2/s$ at 100° C.

7 Claims, No Drawings

TWO-CYCLE LUBRICATING OIL

This invention relates to a lubricant composition useful as a two-cycle oil. More particularly the invention relates to two-cycle oil characterized in that it contains a VI improver, but provides an oil which complies with certain test standards and viscosity requirements for land equipment, gasoline fueled, two-cycle engines, such as motorcycle engines, moped engines, snowmobile engines, lawn mower engines and the like. Two-stroke-cycle gasoline engines now range from small, less than 50 cc engines, to higher performance engines exceeding 500 cc. The development of such high performance engines has created the need for new two-cycle oil standards and test procedures.

Two-cycle engines are lubricated by mixing the fuel and lubricant and allowing the mixed composition to pass through the engine. Various types of two-cycle oils, compatible with fuel, have been described in the art. Typically, such oils contain a variety of additive components in order for the oil to pass industry standard tests to permit use in two-cycle engines.

U.S. Pat. No. 3,544,466 issued Dec. 1, 1970 to McDowell et al. discloses two cycle oils with VI improvers but not in combination with solvents.

Similarly, GB 2,081,299 (1982) discloses two cycle oils containing lower alkanols which may also have VI improvers, but not in combination with solvents.

The present invention is based on the discovery that the proper balance of a polybutene polymer, solvent and a VI improver can provide a two-cycle engine oil of superior viscosity properties.

Accordingly, there has been discovered a two-cycle lubricating oil composition having a Brookfield viscosity of less than 17,000 cP at −40° C. and a kinematic viscosity of at least 6.5 $mm^2/s$ (cSt) at 100° C. comprising an admixture of:

(a) 3 to 50% by weight of a polybutene polymer being a polybutene, polyisobutylene or a mixture of polybutenes and polyisobutylenes having a number average molecular weight of about 400 to 1500;

(b) 5 to 45% by weight of a normally liquid hydrocarbon solvent having a boiling point of up to 380° C.;

(c) 0.01 to 1% by weight of a viscosity index improver;

(d) 20 to 70% by weight of a mineral or synthetic oil of lubricating viscosity; and (e) 1 to 25% by weight of an additive package for two cycle lubricating oil additives such additives being present in an amount to satisfy the JASO M345 standards for two cycle lubricating oil compositions.

All percentages are by weight on an active ingredient basis based on the weight of the fully formulated lubricating oil composition.

The mixture of polybutenes preferably useful in the lubricating oil compositions of this invention is a mixture of poly-n-butenes and polyisobutylene which normally results from the polymerization of $C_4$ olefins and generally will have a number average molecular weight of about 300 to 1500 with a polyisobutylene or polybutene having a number average molecular weight of about 400 to 1300 being particularly preferred, most preferable is a mixture of polybutene and polyisobutylene having a number average molecular weight of about 950. Number average molecular weight (Mn) is measured by gel permeation chromatography. Polymers composed of 100% polyisobutylene or 100% poly-n-butene are also within the scope of this invention and within the meaning of the term "a polybutene polymer".

A preferred polybutene polymer is a mixture of polybutenes and polyisobutylene prepared from a $C_4$ olefin refinery stream containing about 6 wt. % to 50 wt. % isobutylene with the balance a mixture of butene (cis- and trans-) isobutylene and less than 1 wt %. butadiene. Particularly, preferred is a polymer prepared from a $C_4$ stream composed of 6–45 wt. % isobutylene, 25–35 wt. % saturated butenes and 15–50 wt. % 1- and 2-butenes. The polymer is prepared by Lewis acid catalysis.

The solvents useful in the present invention may generally be characterized as being normally liquid petroleum or synthetic hydrocarbon solvents having a boiling point not higher than about 380° C. at atmosphere pressure. Such a solvent must also have a flash point in the range of about 60–120° C. such that the flash point of the two-cycle cycle oil of this invention is greater than 70° C. Typical examples include kerosene, hydrotreated kerosene, middle distillate fuels, isoparaffinic and naphthenic aliphatic hydrocarbon solvents, dimers, and higher oligomers of propylene butene and similar olefins as well as paraffinic and aromatic hydrocarbon solvents and mixtures thereof. Such solvents may contain functional groups other than carbon and hydrogen provided such groups do not adversely affect performance of the two-cycle oil. Preferred is a naphthenic type hydrocarbon solvent having a boiling point range of about 192° C.–250° C. sold as "Exxsol D80" by Exxon Chemical Company. Preferably, there will be employed 10–40% by weight of the solvent or a mixture of solvents.

Suitable viscosity index improvers that may be added to the present lubricating oil compositions include oil soluble polymers having a weight average molecular weight of from about 10,000 to 1,000,000, preferably 20,000 to 500,000, as determined by gel permeation chromatography or light scattering methods. They are used in amounts of from 0.01 to 1% by weight, preferably 0.02 to 0.5% by weight.

Representative examples of such polymers include polyisobutylene, copolymers of ethylene and propylene and higher alpha-olefins, polymethacrylates, methacrylate copolymers, polyalkylmethacrylates, copolymers of styrene and acrylic esters, copolymers of a vinyl compound and an unsaturated dicarboxylic acid, and partially hydrogenated copolymers of styrene/isoprene, styrene/butadiene, and isoprene/butadiene, as well as the partially hydrogenated homopolymers of butadiene and isoprene and copolymers of isoprene/divinylbenzene.

Preferred viscosity index improvers are ethylene copolymers containing from 15 to 90 wt. % ethylene, preferably 30 to 80 wt. % of ethylene and 10 to 85 wt. %, preferably 20 to 70 wt. % of one or more $C_3$ to $C_{28}$, preferably $C_3$ to $C_{18}$, more preferably $C_3$ to $C_8$, alpha-olefins. While not essential, such copolymers preferably have a degree of crystallinity of less than 25 wt. %, as determined by X-ray and differential scanning calorimetry. Copolymers of ethylene and propylene are most preferred. Terpolymers, tetrapolymers, etc., of ethylene, said $C_3$–$C_{28}$ alpha-olefin, and a non-conjugated diolefin or mixtures of such diolefins may also be used. The viscosity modifiers may also be derivatized to include other properties or functions, such as the addition of dispersancy properties. These oil soluble viscosity modifying polymers will generally have number average molecular weight of from 1,000 to 1,000,000, e.g. 20,000 to 250,000, as determined by gel permeation chromatography or osmometry.

The fourth component of the lubricating compositions of this invention is an oil of lubricating viscosity, that is, a viscosity of about 20–180, preferably 55–180 cSt at 40° C., to provide a finished two-cycle oil in the range of 6.5–14 cSt at 100° C.

These oils of lubricating viscosity for this invention can be natural or synthetic oils. Mixtures of such oils are also often useful. Blends of oils may also be used so long as the final viscosity is 20–180 cSt at 40° C.

Natural oils include mineral lubricating oils such as liquid petroleum oils and solvent-treated or acid-treated mineral lubricating oils of the paraffinic, naphthenic or mixed paraffinic-naphthenic types. Oils of lubricating viscosity derived from coal or shale are also useful base oils.

Synthetic lubricating oils include hydrocarbon oils such as polymerized and interpolymerized olefins alkylated diphenyl ethers and alkylated diphenyl sulfides and the derivatives, analogs and homologs thereof.

Oils made by polymerizing olefins of less than 5 carbon atoms and mixtures thereof are typical synthetic polymer oils. Methods of preparing such polymer oils are well known to those skilled in the art as is shown by U.S. Pat. Nos. 2,278,445; 2,301,052; 2,318,719; 2,329,714; 2,345,574; and 2,422,443.

Alkylene oxide polymers (i.e., homopolymers, interpolymers, and derivatives thereof where the terminal hydroxyl groups have been modified by esterification, etherification, etc.) constitute a preferred class of known synthetic lubricating oils for the purpose of this invention, especially for use in combination with alkanol fuels. They are exemplified by the oils prepared through polymerization of ethylene oxide or propylene oxide, the alkyl and aryl ethers of these polyoxyalkylene polymers (e.g., methyl polypropylene glycol ether having an average molecular weight of 1000, diphenyl ether of polyethylene glycol having a molecular weight of 500–1000, diethyl ether of polypropylene glycol having a molecular weight of 1000–1500, etc.) or mono- and polycarboxylic esters thereof, for example, the acetic acid esters mixed $C_3$–$C_8$ fatty acid esters, or the $C_{13}$ Oxo acid diester of tetraethylene glycol.

Another suitable class of synthetic lubricating oils comprises the esters of dicarboxylic acids (e.g., phthalic acid, succinic acid, alkyl succinic acids, alkenyl succinic acids, maleic acid, azelaic acid, suberic acid, sebacic acid, fumaric acid, adipic acid, linoleic acid dimer, malonic acid, alkyl malonic acids, alkenyl malonic acids, etc.) with a variety of alcohols (e.g., butyl alcohol, hexyl alcohol, octyl alcohol, dodecyl alcohol, tridecyl alcohol, 2-ethylhexyl alcohol, ethylene glycol, diethylene glycol monoether, propylene glycol, etc.). Specific examples of these esters include dioctyl adipate, di(2-ethylhexyl)sebacate, di-n-hexyl fumarate, dioctyl sebacate, diisooctyl azelate, diisodecyl azelate, dioctyl phthalate, didecyl phthalate, dieicosyl sebacate, the 2-ethylhexyl diester of linoleic acid dimer, the complex ester formed by reacting one mole of sebacic acid with two moles of tetraethylene glycol and two moles of 2-ethylhexanoic acid and the like.

Esters useful as synthetic oils also include those made from $C_5$ to $C_{18}$ monocarboxylic acids and polyols and polyol ethers such as neopentyl glycol, trimethylol propane, pentaerythritol, dipentaerythritol, tripentaerythritol, etc.

Unrefined, refined and rerefined oils, either natural or synthetic (as well as mixtures of two or more of any of these) of the type disclosed hereinabove can be used in the lubricant compositions of the present invention. Unrefined oils are those obtained directly from a natural or synthetic source without further purification treatment. For example, a shale oil obtained directly from retorting operations, a petroleum oil obtained directly from primary distillation or an ester oil obtained directly from an esterification process and used without further treatment would be an unrefined oil. Refined oils are similar to the unrefined oils except they have been further treated in one or more purification steps to improve one or more properties. Many such purification techniques are known to those of skill in the art such as solvent extraction, secondary distillation, acid or base extraction, filtration, percolation, etc. Rerefined oils are obtained by processes similar to those used to obtain refined oils which have been already used in service, Such rerefined oils are also known as reclaimed or reprocessed oils and often are additionally processed by techniques directed to removal of spent additives and oil breakdown products.

The invention further comprises the presence of 1–25% by weight of an additive package which contains one or more conventional two-cycle lubricating oil additives, and these may be any additive normally included in such lubricating oils for a particular purpose.

Such conventional additives for the additive package component which may be present in the composition of this invention include corrosion inhibitors, oxidation inhibitors, friction modifiers, dispersants, antifoaming agents, antiwear agents, pour point depressants, metal detergents, rust inhibitors, lubricity agents, which are preferred, and the like.

A preferred additive package will comprise (i) polyisobutenyl (Mn 400–2500, preferably Mn 950) succinirnide or other oil soluble, acylated, nitrogen containing lubricating oil dispersant present in such amount to provide 0.2–5 wt. %, preferably 1–3 wt. % dispersant in the lubricating oil and (ii) a metal phenate, sulfonate or salicylate oil soluble detergent additive, which is a neutral metal detergent or overbased such that the Total Base Number is 200 or less, present in such amount so as to provide 0.1–2 wt. %, preferably 0.2–1 wt. % metal detergent additive in the lubricating oil. The metal is preferably calcium, barium or magnesium. Neutral calcium sulfurized phenates are preferred.

Corrosion inhibitors are present in amounts of 0.01–3 wt. %, preferably 0.01–1.5 wt. %, and are illustrated by phosphosulfurized hydrocarbons and the products obtained by reacting a phosphosulfurized hydrocarbon with an alkaline earth metal oxide or hydroxide. Benzotriazole (35 wt. % active ingredient in propylene glycol) is preferred for use in this invention.

Oxidation inhibitors are present in amounts of 0.01–5 wt. %, preferably 0.01–1.5 wt. % and are antioxidants exemplified by alkaline earth metal salts of alkylphenol thioesters having preferably $C_5C_{12}$ alkyl side chain such as calcium nonylphenol sulfide, barium t-octylphenol sulfide, dioctylphenylamines as well as sulfurized or phosphosulfurized hydrocarbons. Also included are oil soluble antioxidant copper compounds such as copper salts of $C_{10}$ to $C_{18}$ oil soluble fatty acids.

Friction modifiers are present in amounts of 0.01–3 wt. %, preferably 0.01–1.5 wt. %, and include fatty acid esters and amides, glycerol esters of dimerized fatty acids and succinate esters or metal salts thereof.

Pour point depressants, also known as lube oil flow improvers, are used in amounts of 0.01–2 wt. %, preferably 0.01–1.5 wt. %, and can lower the temperature at which the fluid will flow and typical of these additives are $C_8$–$C_{18}$ or $C_{14}$ dialkyl fumarate vinyl acetate copolymers, which are preferred, polymethacrylates and wax naphthalene.

Foam control can also be provided by an anti-foamant of the polysiloxane type such as silicone oil and polydimethyl siloxane; acrylate polymers are also suitable. These are used in amounts of 0.01–5 wt. %, preferably 0.01–1.5 wt. %.

Anti-wear agents reduce wear of metal parts and representative materials are zinc dialkyldithiophosphate, zinc diaryl diphosphate, and sulfurized isobutylene. These are used in amounts of 0.01–5 wt. %.

Lubricity agents useful in this invention may be selected from a wide variety of oil soluble materials. Generally, they are present in an amount of 1–20 wt. %, preferably about 5–15 wt. %. Lubricity agents include polyol ethers and polyol esters such as polyol esters of $C_5$–$C_{15}$ monocarboxylic acids, particularly pentaerythritol trimethylol propane and neopentyl glycol soluble esters of such acids, wherein the ester has a viscosity of at least 9 $mm^2/s$ (cSt) at 100° C., natural oils such as bright stock which is the highly viscous mineral oil fraction derived from the distillation residues formed as a result of the preparation of lubricating oil fractions from petroleum.

A preferred lubricity agent is an α-olefin/dicarboxylic acid ester copolymer having a viscosity of 20 to 50 $mm^2/s$ (cSt) at 100° C., which is represented by the following general formula:

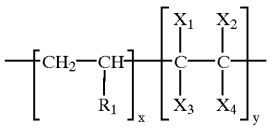

wherein $R_1$ is a straight-chain or branched alkyl group; $X_1$, $X_2$, $X_3$ and $X_4$ may be the same or different and are each hydrogen, a straight-chain or branched alkyl group, a group represented by the formula —$R_2$—$CO_2R_3$ or an ester group represented by the formula —$CO_2R_4$ wherein $R_2$ is a straight-chain or branched alkylene group, $R_3$ and $R_4$ may be the same or different and are each a straight-chain or branched alkyl group, any two of $X_1$, $X_2$, $X_3$ and $X_4$ are each said ester group; and x and y may be the same or different and are each a positive number.

The structure above represented by the formula

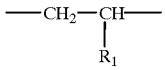

is derived from an α-olefin, and the number of carbon atoms of the α-olefin is preferably 3 to 20, still preferably 6 to 18. Examples of the α-olefin include propylene, 1-butene, 1-pentene, 1-hexene, 1-heptene, 1-octene, 1-nonene, 1-decene, 1-undecene, 1-dodecene, 1-tridecene, 1-tetradecene, 1-pentadecene, 1-hexadecene, 1-heptadecene, 1-octadecene, 1-nonadecene and 1-eicosene.

The structure above represented by the formula

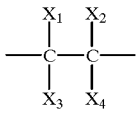

is derived from an ester of a dicarboxylic acid having ethylene linkage. Examples of the dicarboxylic acid include maleic acid, fumaric acid, citraconic acid, mesaconic acid, and itaconic acid. The alcohol is preferably one having 1 to 20 carbon atoms, still preferably one having 3 to 8 carbon atoms. Examples of the alcohol include methanol, ethanol, propanol, butanol (preferred), pentanol, hexanol, heptanol, octanol, nonanol, decanol, undecanol, dodecanol, tridecanol, tetradecanol, pentadecanol, hexadecanol, heptadecanol, octadecanol, nonadecanol and eicosanol. The component (A) is prepared by copolymerizing the above-described α-olefin with the above-described ester of a dicarboxylic acid. This process is described in detail in Japanese Patent Application Laid-Open Gazette No. (Sho.) 58-65246. The molar ratio of the α-olefin (x) to the ester (y) of a dicarboxylic acid is preferably x:y=1:9 to 9:1. The number average molecular weight of the ester copolymer is preferably 1000 to 3000. The kinematic viscosity should be 20 to 50 $mm^2/s$ (cSt) at 100° C., preferably 30 to 40 $mm^2/s$ (cSt) at 100° C. These materials are available under the trademark "Ketjenlube" from Akzo Chemicals, Inc.

Preferred for use in the invention is "Ketjenlube 135" a butanol ester of a alpha-olefin maleic acid copolymer having an Mn of 1800 and a viscosity of 35 $mm^2/s$ (cSt) at 100° C.

Other suitable lubricity agents include phosphorus containing additives such as dihydrocarbyl hydrocarbyl phosphonates and sulfur containing lubricity agents such as sulfurized fats, sulfurized isobutylene, dialkyl polysulfides, and sulfur bridged phenols such as nonylphenol polysulfide.

Other suitable lubricity agents include fatty acids (including dimers and trimers thereof) fatty ethers, fatty esters and methoxylated fatty ethers and esters such as ethylene oxide/propylene oxide copolymers and fatty esters of these materials as well as natural materials such as vegetable oils, glycerides and the like. Still further suitable lubricity agents include borate esters such as tricresyl borate ester condensates and phosphorus containing esters such as tricresyl phosphate and other trialkyl and triaryl phosphites and phosphates. Other lubricity agents include orthophosphate or sulfate salts of primary or secondary aliphatic amines having 4 to 24 carbon atoms, dialkyl citrates having an average of from 31/2 to 13 carbon atoms in the alkyl groups, aliphatic dicarboxylic acids and esters thereof, chlorinated waxes and polyhaloaromatic compounds such as halogenated benzenes and naphthlenes.

The lubricating oil compositions of the present invention will mix freely with the fuels used in such two-cycle engines. Admixtures of such lubricating oils with fuels comprise a further embodiment of this invention. The fuels useful in two-cycle engines are well known to those skilled in the art and usually contain a major portion of a normally liquid fuel such as a hydrocarbonaceous petroleum distillate fuel, e.g., motor gasoline is defined by ASTM specification D-439-73. Such fuels can also contain non-hydrocarbonaceous materials such as alcohols, ethers, organo nitro compounds and the like, e.g., methanol, ethanol, diethyl ether, methylethyl ether, nitro methane and such fuels are within the scope of this invention as are liquid fuels derived from vegetable and mineral sources such as corn, alpha shale and coal. Examples of such fuel mixtures are combinations of gasoline and ethanol, diesel fuel and ether, gasoline and nitro methane, etc. Gasoline is preferred, i.e., mixture of hydrocarbons having an ASTM boiling point of 60° C. at the 10% distillation point to about 205° C. at the 90% distillation point. Lead-free gasoline is particularly preferred.

The lubricants of this invention are used in admixture with fuels in amounts of about 20 to 250 parts by weight of fuel per 1 part by weight of lubricating oil, more typically about 30–100 parts by weight of fuel per 1 part by weight of oil.

The invention is further illustrated by the following examples which are not to be considered as limitative of its scope.

EXAMPLES

Two oils were evaluated in accordance with the JASO M345 test procedures JASO M340, M341, M342 and M343.

This is an engine test established by Society of Automotive Engineers of Japan (JSAE) for two-cycle gasoline engine oils. As of Jul. 1, 1994, oils used in two-cycle engines are being labeled in accordance with the JASO-M345 standards as announced by the Japan Automobile Standards Organization (JASO). JASO published the JASO M345 standards in April, 1994. "EGD Detergency" is a reference to a further modification of the normal JASO M341 detergency test (1 hour) procedure in which the test is run for 3 hours. This is a more stringent standard expected to be adopted by ISO (the International Organization for Standardization) as published by Committee Draft of Jan. 5, 1995 of the Technical Committee 28. "FC" is the highest performance standard for the JASO M345 standards. Results are in the Table. Oil B is an oil of the invention and Oil A is for is for comparative purposes. Oil A was not engine tested because its KV (kinematic viscosity) was not satisfactory.

"Active ingredient" refers to a solution of the additive in mineral oil, or other carrier where indicated.

TABLE

Two Stroke Oil With and Without VI

| Component | Oil A Mass % | Oil B Mass % |
|---|---|---|
| (a) Dispersant Adpack | 6.0 | 6.0 |
| (b) 950 MW PIB | 30.0 | 30.0 |
| (c) Exxsol D80 Solvent | 27.0 | 27.0 |
| (d) LOFI | 0.5 | 0.5 |
| (e) VI | None | 2.0 |
| (f) Paraffinic Hydrocarbon Solvent | 12.0 | 12.0 |
| (g) Base Stock | 24.5 | 22.5 |
| | 100.0 | 100.0 |

| Analytical Testing | Method | Result | Result | ISO-EGD Limit |
|---|---|---|---|---|
| Brookfield @ −40° C., cP | LTC WM4-3.2 | 16,540 | 16,120 | |
| KV @ 100° C., cSt | ASTM D445 | 6.16 | 6.88 | ≧6.5 |
| PM Flash Point, ° C. | ASTM D93 | 88 | 92 | ≧70 |
| Sulfated Ash, wt. % | ASTM D874 | 0.10 | 0.10 | ≦0.18 |
| Engine Testing | | | | |
| 3-hour Detergency | M 341-92 | | 136 | ≧125 |
| 3-hour Varnish | M 341-92 | | 102 | ≧95 |
| Lubricity | M 340-92 | | 102 | ≧95 |
| Initial Torque | M 340-92 | | 99 | ≧98 |
| Exhaust Smoke | M 342-92 | | 127 | ≧85 |
| Exhaust Blocking | M 343-92 | | 130 | ≧90 |

Notes for Table:
(a) The Dispersant Adpack comprises 40.2% (52 wt. % active ingredient) of a borated Mn 950 polyisobutenyl succinimide dispersant, 25% (67.6 wt. % active ingredient) nonyl phenol sulfide, 9.7% (51 wt. % active ingredient) calcium sulfurized phenate, 0.5% benzotriazole (35 wt. % active ingredient in propylene glycol) and the balance an aliphatic hydrocarbon solvent ("Exxsol D-80").

TABLE-continued

Two Stroke Oil With and Without VI (b) "PIB" is polyisobutylene.
(d) "LOFI" is lube oil flow improver, 40 wt. % active ingredient, $C_8$—$C_{18}$ dialkylfumarate-vinyl acetate copolymer.
(e) VI is "Paratone 8453", an ethylene propylene copolymer (4.5 wt. % active ingredient) having an Mn of 150,000 (GPC).
(g) The basestock is a hydrocarbon mineral oil.

What is claimed is:

1. A two-cycle lubricating oil composition having a Brookfield viscosity of less than 17,000 cP at −40° C. and a kinematic viscosity of at least 6.5 $mm^2/s$ (cSt) at 100° C. which comprises an admixture of:

(a) 3–50 wt. % of a polybutene polymer having a Mn of about 400–1500;

(b) 5–45 wt. % of a normally liquid aliphatic hydrocarbon solvent having a boiling point of up to 380° C.;

(c) 0.01–1 wt. % of a viscosity index improver;

(d) 20–70 wt. % of a mineral oil of lubricating viscosity; and (e) 1–25 wt. % of an additive package for two cycle lubricating oil compositions, such additives being present in an amount to enable the two-cycle lubricating oil composition to satisfy the JASO-M345 standards for two-cycle oil lubricating composition, said additive package comprising an oil soluble acylated nitrogen containing dispersant present in such amount to provide 0.2–5 wt. % dispersant in the lubricating oil.

2. The composition of claim 1 wherein the (a) ingredient has an Mn of about 950.

3. The composition of claim 1 wherein the (c) ingredient is an ethylene-alphaolefin copolymer viscosity index improver, present in an amount of 0.02–0.5 wt. %.

4. The composition of claim 1 wherein the (e) ingredient comprises a polyisobutenyl succininmide dispersant.

5. The composition of claim 1 wherein the (e) ingredient comprises a metal phenate, sulfonate or salicylate detergent having a Total Base Number 200 or less.

6. The composition of claim 1 wherein there is present about 10–40 wt. % of the (b) ingredient.

7. The composition of claim 1 wherein there is present 10–35 wt. % of the (a) ingredient.

* * * * *